US012042032B1

(12) United States Patent
Shlaferman

(10) Patent No.: US 12,042,032 B1
(45) Date of Patent: Jul. 23, 2024

(54) AUXILIARY STORAGE UNIT FOR USE WITH AN ELECTRONIC DEVICE

(71) Applicant: Dynamite MArketing, Inc., New York, NY (US)

(72) Inventor: Alexander Shlaferman, Brooklyn, NY (US)

(73) Assignee: DYNAMITE MARKETING, INC., New York, NY (US)

( * ) Notice: Subject to any disclaimer, the term of this patent is extended or adjusted under 35 U.S.C. 154(b) by 0 days.

(21) Appl. No.: 18/382,656

(22) Filed: Oct. 23, 2023

(51) Int. Cl.

| | |
|---|---|
| ***A45C 11/18*** | (2006.01) |
| ***A45F 5/02*** | (2006.01) |
| *A45C 11/00* | (2006.01) |
| *A45F 5/00* | (2006.01) |

(52) U.S. Cl.
CPC ..... *A45C 11/182* (2013.01); *A45F 5/021* (2013.01); *A45C 2011/002* (2013.01); *A45C 2011/003* (2013.01); *A45F 2005/006* (2013.01); *A45F 2200/055* (2013.01)

(58) Field of Classification Search
CPC ..... A45C 11/182; A45C 2011/002; A45C 2011/003; A45F 5/021; A45F 2200/055; A45F 2005/006
USPC ..... 206/320
See application file for complete search history.

(56) References Cited

U.S. PATENT DOCUMENTS

| | | | | |
|---|---|---|---|---|
| 9,027,746 | B2 * | 5/2015 | Smith | A45C 11/00 206/320 |
| 9,756,916 | B2 * | 9/2017 | Lawson | A45C 11/182 |
| 10,506,857 | B2 * | 12/2019 | Altschul | A45C 13/002 |
| 2016/0324285 | A1 * | 11/2016 | Zavala | A45C 11/321 |
| 2018/0006676 | A1 * | 1/2018 | Zavala | A45C 1/08 |
| 2018/0184775 | A1 * | 7/2018 | Altschul | A45C 11/182 |
| 2022/0031032 | A1 * | 2/2022 | Bauer | A45C 1/06 |

* cited by examiner

*Primary Examiner* — Sue A Weaver
(74) *Attorney, Agent, or Firm* — Weitzman Law Offices, LLC

(57) ABSTRACT

An apparatus involves an elastic silicone pocket having a portion sandwiched between two plates, wherein the two plates are coupled to each other via at least one post which passes through the portion.

15 Claims, 8 Drawing Sheets

AUXILIARY STORAGE UNIT FOR USE WITH AN ELECTRONIC DEVICE

FIELD OF THE INVENTION

This disclosure relates generally to electronic devices and, more particularly, to storage components associated with electronic devices.

BACKGROUND

Electronic devices like cell phones, tablet and laptop computers have become ubiquitous. However, in some cases it may be desirable to carry one or more such devices and a few additional items that the user desires to have handy, but not tote everything around in a large carrier (i.e., purse, backpack, holster, etc.).

While, of course, in some instances, one could carry such additional items in their pockets, in other circumstances, the same need may exist, but the person may not have pockets at all, for example, because they are wearing a dress, a form fitting jacket, slacks or other clothing or wearing other clothing that is either not suitable for carrying such items or doing so will detract from the desired look.

"Wallets" do exist that are part of, or can be attached to, an electronic device. such as a cell phone. However, such "wallets" are incapable of holding more than a few business cards or larger/awkwardly shaped objects, like lighters, lip balm containers, a keychain of keys, etc.

SUMMARY

This disclosure describes solutions that provide significant advances in addressing the aforementioned problems.

One aspect of this disclosure involves an apparatus having an elastic silicone pocket having a base surface including one or more holes therein, a first plate positioned within the elastic silicone pocket having a side abutting a first side of the base surface, a second plate having a first side abutting a second side of the base surface opposite the first side, and at least one post coupling the first plate to the second plate via the one or more holes such that the base surface is sandwiched between the first and second plates.

Another aspect of this disclosure involves an apparatus having an elastic pocket having a portion sandwiched between two plates, wherein the two plates are coupled to each other via at least one post which passes through the portion, wherein the portion sandwiched between the two plates and at least one post are configured such that stretching a front of the elastic pocket will cause some of the elastic pocket to deform and extend from between the two plates to outside the two plates.

Yet another aspect of this disclosure involves an apparatus for use with an electronic device includes a frame having a periphery dimensioned for coupling about a peripheral edge of an electronic device, an elastic silicone pocket having a base surface with multiple holes therein, a first plate positioned within the pocket abutting a first side of the base surface such that part of the elastic silicone pocket wraps around the first rigid plate, a second plate abutting a second side of the base surface opposite the first side, multiple posts within the holes coupling the first plate to the second plate such that the base surface is sandwiched between the first and second plates, wherein part of a peripheral edge of at least the second plate is coupled to part of the periphery of the frame such that a back of an electronic device inserted into the frame will abut the second plate on a side of the second plate opposite the elastic silicone pocket.

BRIEF DESCRIPTION OF THE DRAWINGS

This disclosure is further described in the detailed description that follows, with reference to the drawings, wherein the same reference numbers appearing in the various drawings and description designate corresponding or like elements among the different views. and in which.

DETAILED DESCRIPTION

Figure 3:
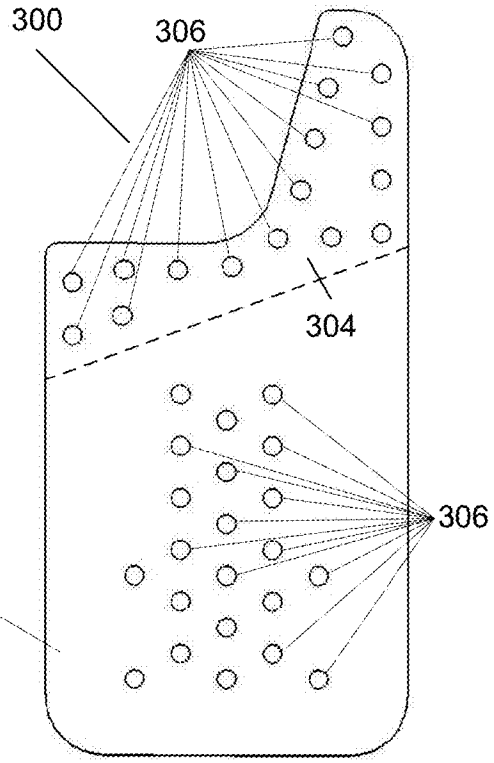
FIG. 3 illustrates, in simplified form, an example base plate for auxiliary storage units in accordance with the teachings herein
Figure 2:
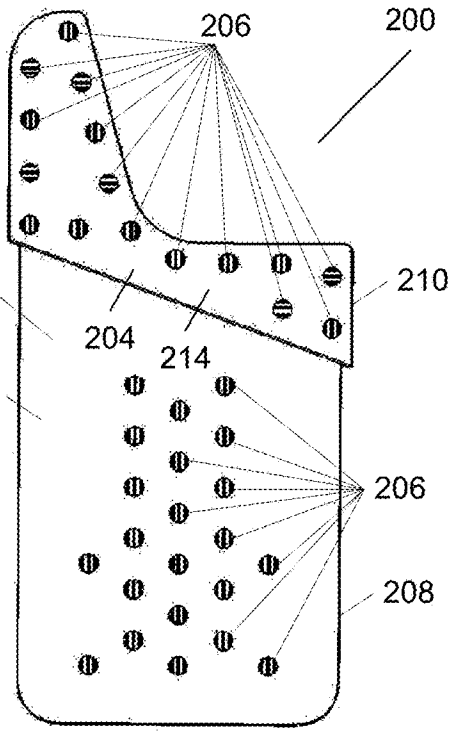
FIG. 2 illustrates, in simplified form, an example support plate for auxiliary storage units in accordance with the teachings herein.

FIGS. 1A-1B and FIGS. 2-3 collectively illustrate, in simplified form, representative example implementations of the three components of auxiliary storage units in accordance with the teachings herein. More specifically, FIGS. 1A-1B respectively illustrate, in simplified form, a perspective view of an example pocket component, viewed from the base side (FIG. 1A) and a top view of the pocket (FIG. 1B), FIG. 2 illustrates, in simplified form, an example first rigid plate component, and FIG. 3 illustrates, in simplified form, an example second rigid plate component.

For purposes of simple understanding, in overview a combination of implementations of these three components, according to the teachings herein, are all that is needed to create an example implementation of our auxiliary storage unit.

With the forgoing in mind, each component will now be discussed in detail.

Figure 1A:
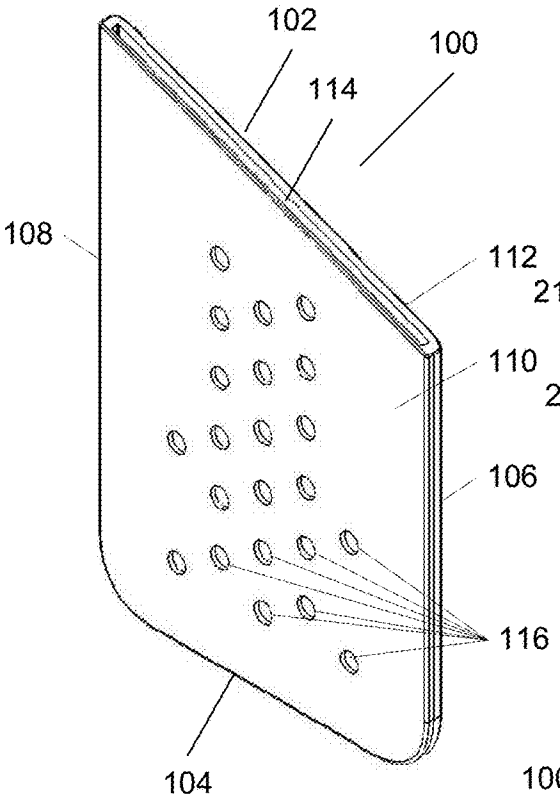
FIG. 1A illustrates an example implementation of a pocket for auxiliary storage units in accordance with the teachings herein.

Turning to FIG. 1A, FIG. 1A illustrates an example implementation of a pocket 100 for auxiliary storage units in accordance with the teachings herein. The pocket 100 is made of an elastomer, typically silicone rubber, having a hardness of between about 15 Shore A and about 55 Shore A measured with a Shore A durometer (the "about" reflecting the variation known in the art to be acceptable calibration error or measurement uncertainty). More particularly, ideally, the pocket 100 should have a hardness in the range of about 18 Shore A to about 35 Shore A.

The pocket 100 includes a top edge 102, a bottom 104, and two sides 106, 108. As shown, the top edge 102 of the pocket 100 is angled, however, the specific shape of the top edge 102 in this regard is a matter of design choice. The pocket 100 also includes a base side surface 110 and a front side surface 112 spaced apart from the base side surface 110 by the bottom 104 and sides 106, 108 so as to form a cavity 114 therewithin. In addition, the base side surface 110 includes one or more holes 116 extending into the cavity, the purpose of which will be described in greater detail below.

Figure 1B:
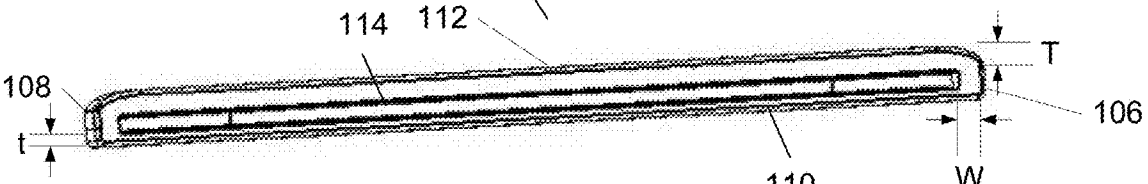
FIG. 1B is a top view of the pocket of FIG. 1A.

FIG. 1B is a top view of the pocket 100 of FIG. 1A. As more clearly shown, in FIG. 1B, with many implementations, the front side surface 112 of the pocket 100 has a thickness "T" that is greater than the thickness "t" of the base side surface 110 and a side wall width "W" which is typically, but not necessarily equal to the thickness "T". For purposes of example only, in one example implementation, the thickness "T" is 1.7 mm (about 0.067 inches) and the thickness "t" is 0.79 mm (about 0.031 inches) and W is 1.76 mm (about 0.069 inches).

Turning now to FIG. 2, FIG. 2 illustrates, in simplified form, another component, an example support plate 200 for auxiliary storage units in accordance with the teachings herein.

The support plate 200 is made of a material with a high flexural modulus (i.e., it is fairly stiff), typically a moldable or 3D printable polymer, for example, as contemplated, appropriate plastics may include, but are not limited to polycarbonate (PC), acetal-polyamide-imide (PAI), polyether ether ketone (PEEK), Polyetherimide (PEI), fiber reinforced Polyphenylene (PPE), although metal or other materials, or combinations of the foregoing materials, can be used depending upon the specific implementation.

The support plate 200 is made up of two portions, one portion 202 that gets inserted into the pocket 100 and another portion 204 that will be outside the pocket 100.

As shown, the example support plate 200 of FIG. 2 would be made of a molded stiff plastic and includes one or more posts 206 on at least the portion 202 that goes into the pocket 100 and that correspond, in number, shape and placement to the holes 116 in the pocket 100 with which it will be used. Optionally, the other portion 204 may also include, but need not have, posts 206, for example to facilitate alignment or bonding with a base plate as will be described below.

In addition, the outer periphery 208 of the portion 202 is typically recessed from the outer periphery 210 by an amount "W" (i.e., the sidewall width of the pocket 100) so that, when the portion 202 is within the pocket 100, the outer periphery of the sides 106, 108 of the pocket 100 will be aligned with the outer periphery 210 of the outer portion 204. Still further the portion 202 is thinner than the portion 204 and designed so that the pocket-side face 212 of the portion 202 is recessed from the pocket-side face 214 of the portion 204 by roughly the thickness "t" of the pocket 100, so that when inserted into the pocket, the pocket-side surface 212 will be essentially flush with the base side surface 110 of the pocket 100.

FIG. 3 illustrates, in simplified form, another component, an example base plate 300 for auxiliary storage units in accordance with the teachings herein.

As shown, the base plate 300 conceptually has two portions, one portion 302 typically corresponding in size and shape to the periphery formed by the bottom 104, and two sides 106, 108 of the pocket 100, and the other portion 304 typically corresponding in size and shape to the outer periphery 210 of the portion 204 of the support plate 200.

In addition, the base plate 300 may optionally include areas 306, in the form of shallow indents or holes that facilitate alignment and/or bonding of the base plate 300 and support plate 200 to each other as will be described below.

As will become apparent from the below, when the pocket 100, support plate 200 and base plate 300 are assembled, part of the pocket will be sandwiched between the support plate 200 and base plate 300.

Note here that the posts 206 that will couple the support plate 200 and base plate 300, when assembled, are located at positions removed from the periphery of the support plate 200. That is intentional so that, when an object is placed into the pocket, post assembly, some of the pocket 100 that is sandwiched between them near the periphery can stretch from between the support plate 200 and base plate 300 to outside the support plate 200 and base plate 300. In addition, with some implementations, the pocket and/or holes can be slightly undersized (e.g., by about 5% or less) so that the pocket must be slightly stretched to accommodate the posts. In this manner, the posts can more easily retain the pocket in place during the joining process that will now be described.

Figure 4C:
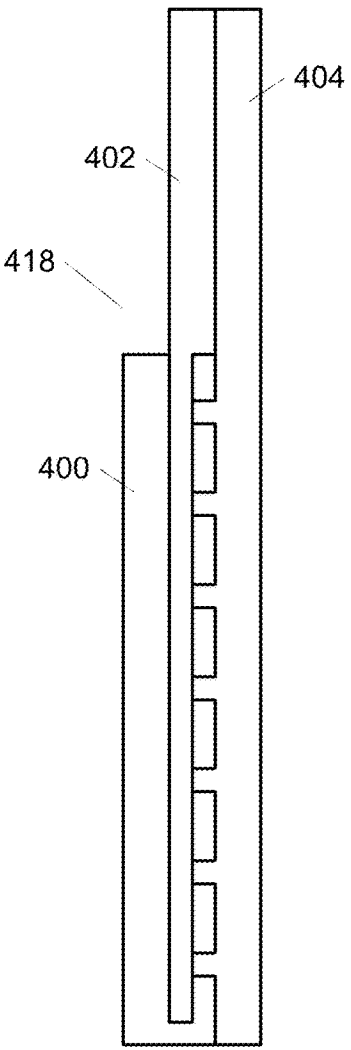
FIGS. 4A-4C illustrate, in simplified form, the steps involved in construction of an example auxiliary storage unit using component variants of those described in FIGS. 1A, 1B, 2 and 3.
Figure 4B:
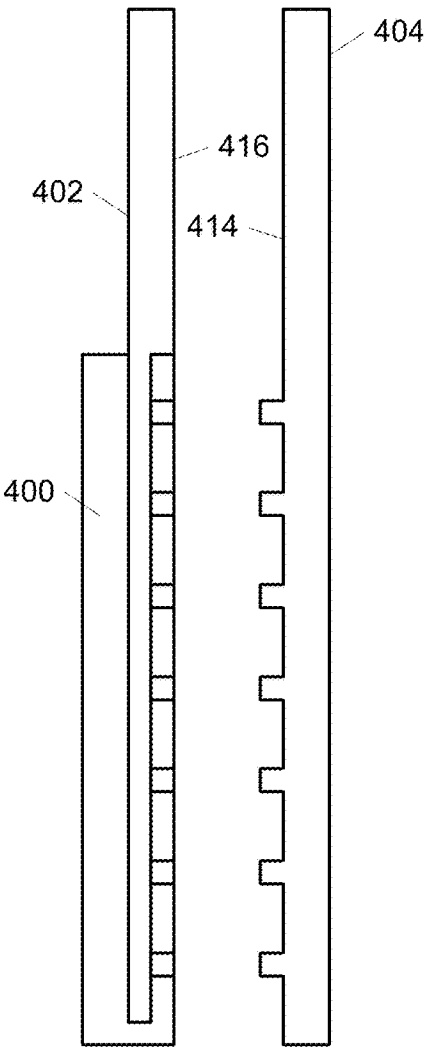
Figure 4A:
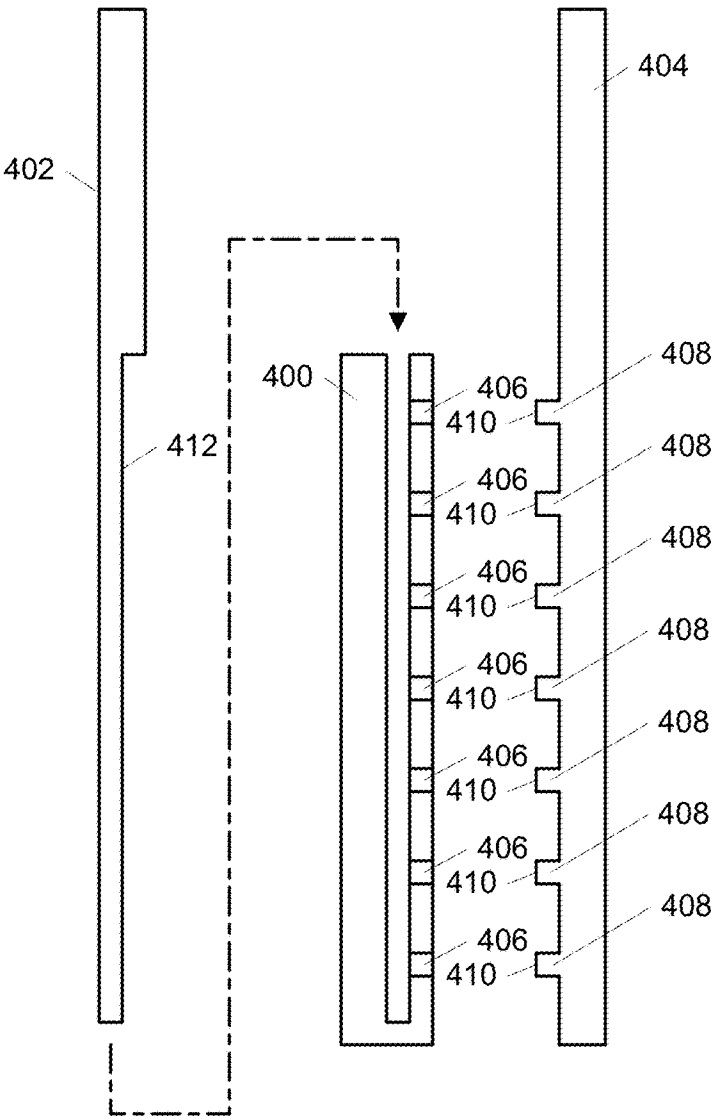

FIGS. 4A-4C illustrate, in simplified form, the steps involved in construction of an example auxiliary storage unit using component variants of those described in FIGS. 1A, 1B. 2 and 3, (for purposes of understanding, shown in longitudinal cross section).

As shown in FIG. 4A, there is, in cross section, a pocket 400, a support plate 402 and a base plate 404 similar to those previously described, except that neither the support plate 402 nor the base plate 404 include any posts above the pocket 400. As further shown in FIG. 4A, the pocket 400 includes multiple holes 406 consistent with the description above. However, with this variant implementation, posts 408 corresponding to the holes 406 are formed on the base plate 404 instead of the support plate 402.

To construct the example auxiliary storage unit, the support plate 402 is inserted into the pocket 400. FIG. 4B illustrates, in simplified form, a result of the insertion of the support plate 402 into the pocket 400.

Then, the base plate 404 is brought into aligned contact with the base-side surface 110 of the pocket 400 such that: (i) the posts 408 extend into the corresponding holes 406 and the face surfaces 410 of the posts contact the corresponding face surface 412 of the support plate 402 with the base-side surface 110 of the pocket 400 being sandwiched between the support plate 402 and base plate 404, and (ii) the respective face surfaces 414, 416 of the base plate 404 and support plate 402 are also in contact with each other. Once this is done, the surfaces 410, 412, 414, 416 are joined, for example, using ultrasonic welding. Alternatively, for some implementations, depending upon the particular materials used, in lieu of ultrasonic welding, one or both of the opposing the surfaces 410, 412, 414, 416 can be joined using an applied adhesive that, for example, creates a bond upon contact, creates a bond based upon a chemical reaction between a material on one surface and another material on the opposing surface, creates a bond based upon the application of pressure, heat or light energy (e.g., ultraviolet curing), etc. Alternatively, for some implementations, other joining methods such as clips, rivets, snaps, screws, or other mechanical fasteners that are capable of joining the two plates together with the base-side surface of the pocket in between can be used, although for some implementations there may be disadvantages to use of such mechanical devices.

FIG. 4C illustrates, in simplified form (in cross section), a completed auxiliary storage unit 418 resulting from the joining.

Figure 5C:
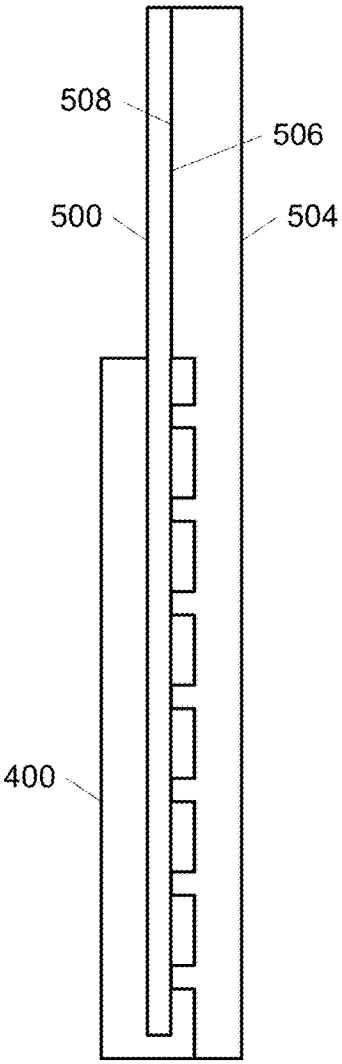
FIGS. 5A-5C illustrate, in simplified form, the steps involved in construction of another example variant auxiliary storage unit.
Figure 5B:
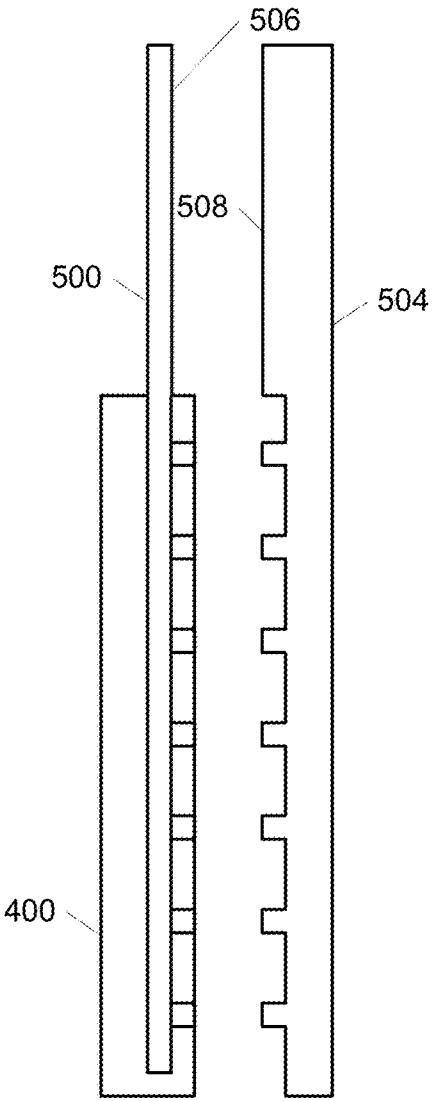
Figure 5A:
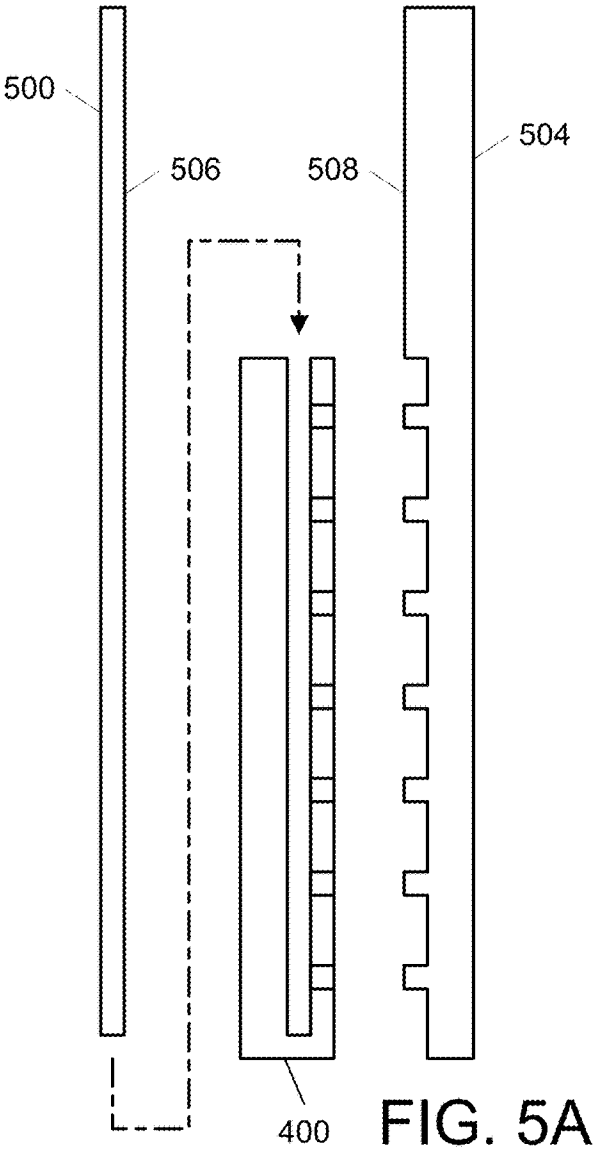

FIGS. 5A-5C illustrate, in simplified form, the steps involved in construction of another example variant auxiliary storage unit in the same manner as in FIGS. 4A-4C except that, with the variants of FIG. 5A, the support plate 500 has a pocket side face 506 that is entirely flat and the base plate 504 is constructed such that it includes a surface 508 above the pocket 400 that protrudes by an amount equal to the thickness "t" of the base-side surface 110 such that, when brought together the pocket side face 506 and surface 508 will abut and can be joined as described above.

Figure 6:
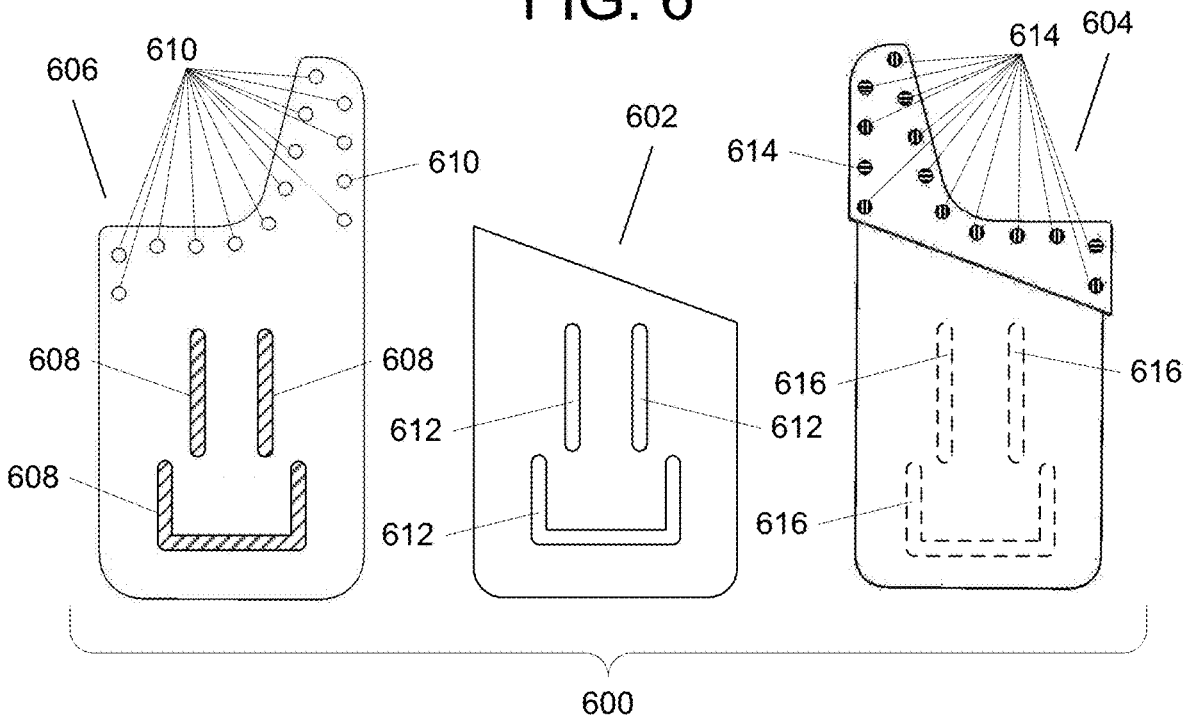
FIG. 6 illustrates, in simplified form, a few alternative variant components configured for combination, and which can be combined to form an auxiliary storage unit, based upon the teachings herein.

FIG. 6 illustrates, in simplified form, a few alternative variant components 600 configured for combination, and which can be combined to form an auxiliary storage unit, based upon the teachings herein. As shown in FIG. 6, there are a pocket 602, a support plate 604 and base plate 606 similar to those described above except, in FIG. 6, the base plate 606 includes elongated posts 608 and a series of through holes 610, the pocket 602 includes holes 612 of size and shape corresponding to the posts 608 and the support plate 604 includes a series of posts 614 dimensioned to snugly fit into the through holes 610 such that their terminal end is flush with the back of the base plate 606. During construction, the posts 608 of the base plate 606 will be joined to the support plate 604 in corresponding areas 616 on the support plate 604.

Figure 7:
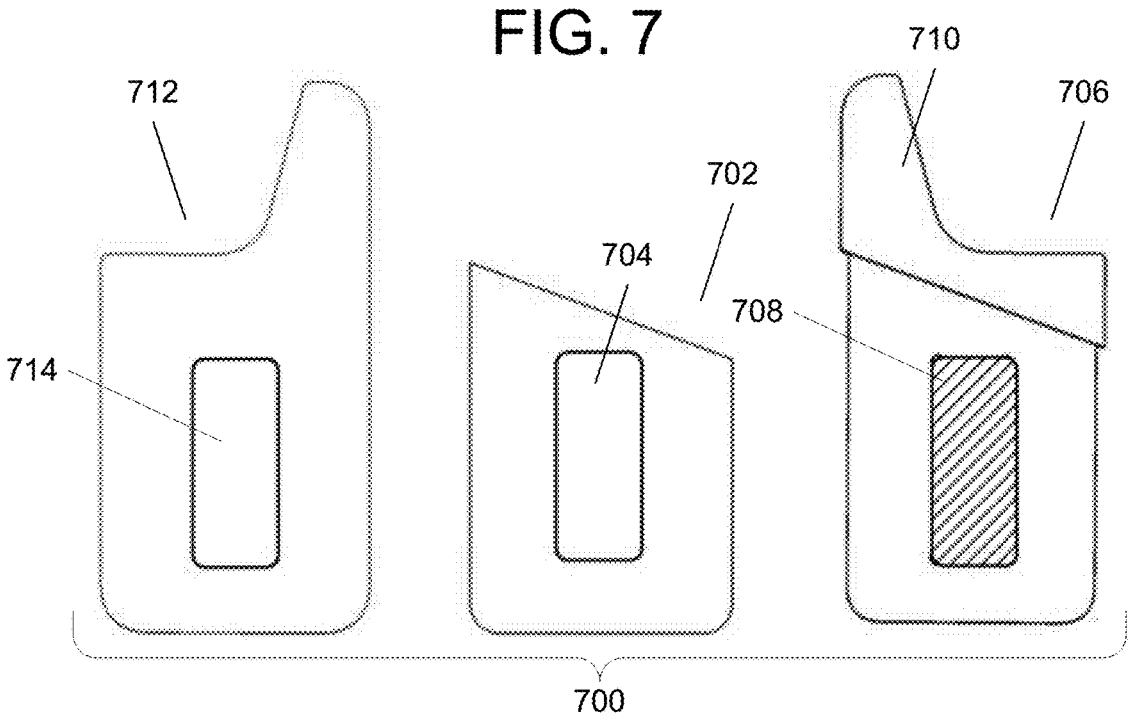
FIG. 7 illustrates, in simplified form, another set of alternative variant components configured for combination, and which can be combined to form, an auxiliary storage unit, based upon the teachings herein.

FIG. 7 illustrates, in simplified form, another set of alternative variant components 700 configured for combination, and which can be combined to form, an auxiliary storage unit, based upon the teachings herein.

As shown, the pocket 702 includes a single rectangular hole 704, and the support plate 706 includes a single post 708 with which the hole 704 in the pocket 702 coincides. The support plate is also smooth on its upper portion 710. The base plate 712 is also substantially smooth, except that it includes a slight recess 714 dimensioned to correspond to the post 708 and hole 704, to ensure proper alignment when the components 702, 706, 712 are brought together and joined.

Figure 8:
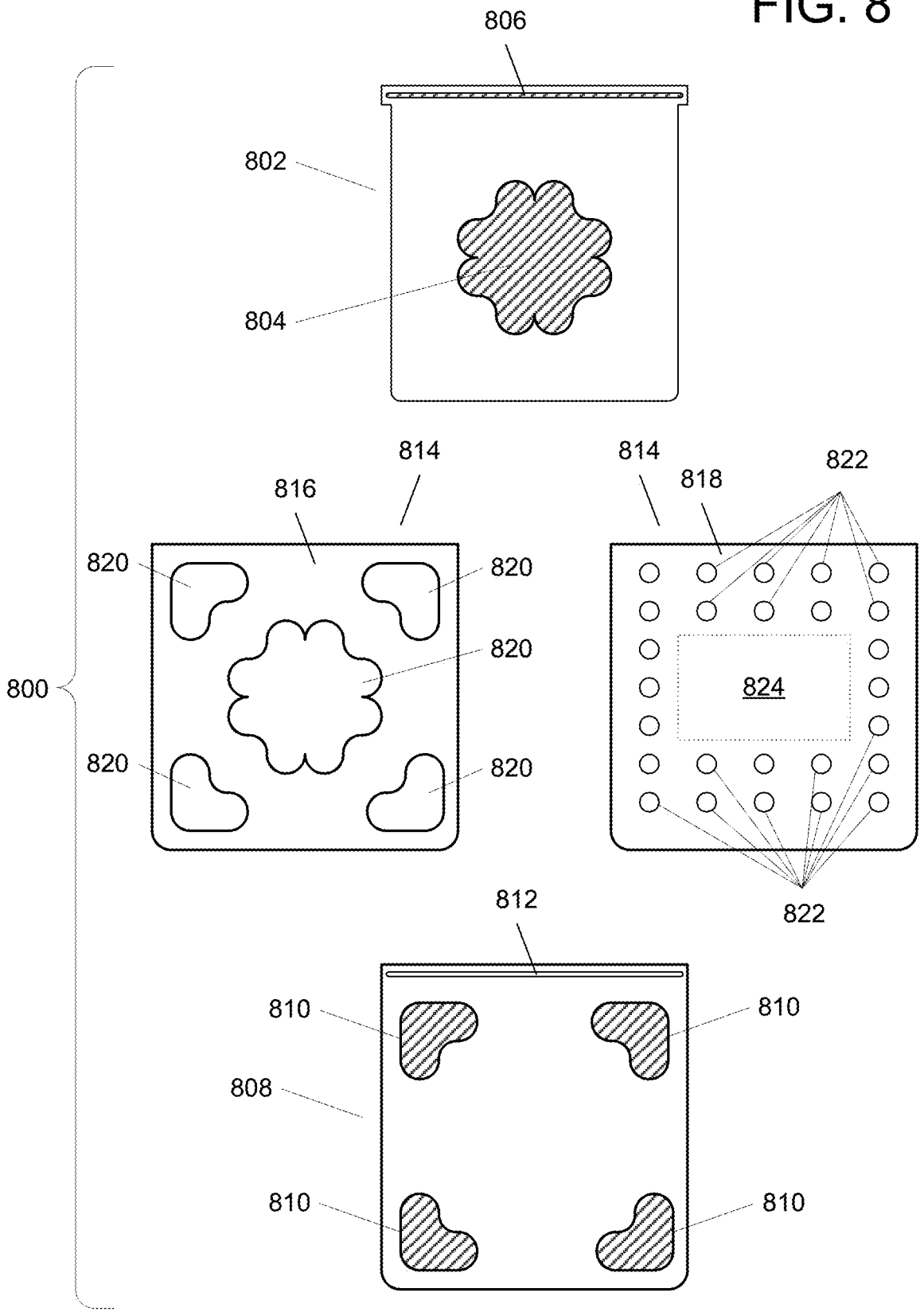
FIG. 8 illustrates, in simplified form, yet another set of alternative variant components configured for combination, and which can be combined to form, an auxiliary storage unit, based upon the teachings herein.

FIG. 8 illustrates, in simplified form, yet another set of alternative variant components 800 configured for combination, and which can be combined to form, an auxiliary storage unit, based upon the teachings herein. Whereas the previous variants have has a largely rectangular overall shape, the variant of FIG. 8 is essentially square.

As shown in FIG. 8, the support plate 802 includes a single clover-like post 804 and a narrow longitudinal post 806, the base plate 808 also includes posts 810 shaped like angles and a slot 812 essentially corresponding in size to the narrow longitudinal post 806 so that the narrow longitudinal post 806 can snugly fit within the slot 812 to thereby align the support plate 802 and base plate 808 when the two are brought together. The pocket 814 base side 816 includes holes 820 corresponding to both the post 804 of the support plate 802 and the posts 810 of the base plate 808.

In this example variant, the pocket 814 front 818 includes holes 822 that can be positioned to increase the "stretchiness" of the pocket 814. Notably, the holes 822 do not cover the entire surface, which allows for an area 824 where, for example, a symbol, logo and/or words can be embossed, printed or otherwise included or attached.

Thus, it should now be understood and appreciated that the one or more posts are not required to be formed on a particular plate. Moreover, some implementations could readily be constructed that create the one or more posts as separate components that get inserted into the one or more holes of a pocket before, or concurrent with, one or both of the support plate and/or base plate being brought into contact with the pocket. For example, the one or more post(s) could be inserted into corresponding hole(s) in the pocket, one of the support plate or base plate could then be brought into appropriately placed contact with the pocket and post(s) and joined, and then the other of the support plate or base plate could be brought into appropriately placed contact with the pocket and post(s) and joined.

Having shown and described the various components and how they are attached, it should be appreciated that the resulting auxiliary storage unit can be used in the final combined state as, for example, a wallet that can go into a pocket or handbag. Alternatively, variants that incorporate a lanyard, can allow the front side to be used for storage while the back side can have an item such as an identification badge or magnetic or RF "card key" attached to it.

Likewise, by incorporating an adhesive on the base plate on the side opposite the pocket front, the resulting auxiliary storage unit can be affixed to, for example, a cell phone back, personal computer case, tablet computer back or anywhere else where such storage may be desired. Likewise, the components and process described above readily scales in size to accommodate larger items or to more closely conform to the size/shape of, for example, a laptop computer case or tablet computer.

One drawback to the foregoing is that, in some instances, it may not be desirable to attach the auxiliary storage component to, for example, a cell phone, tablet computer, or a specific cell phone case, via adhesive. Advantageously, variants can be constructed that do not require doing so by integrating the auxiliary component with a frame to form an integral case for the cell phone or tablet computer.

Figure 9C:
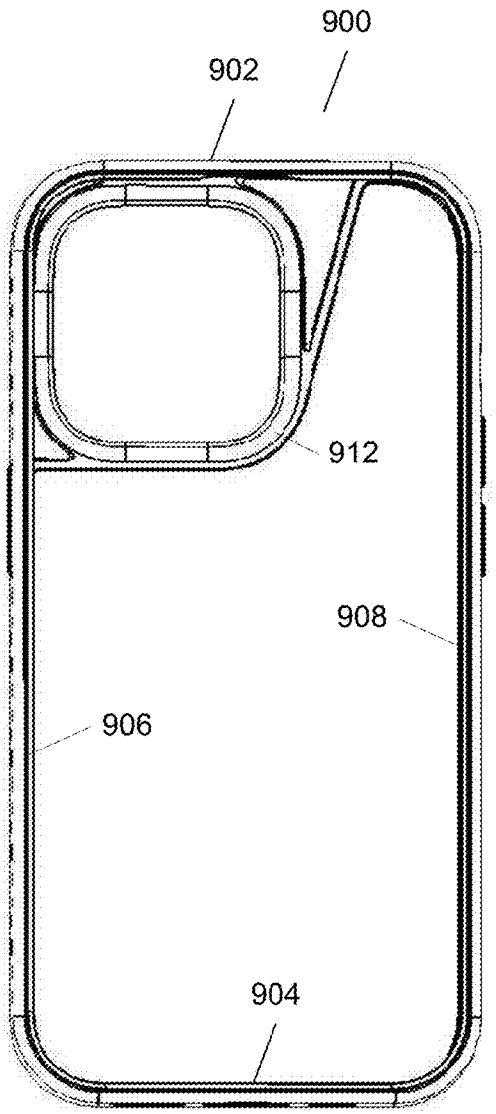
FIG. 9C is a plan view of the frame from the side into which the intended cell phone would be inserted.
Figure 9B:
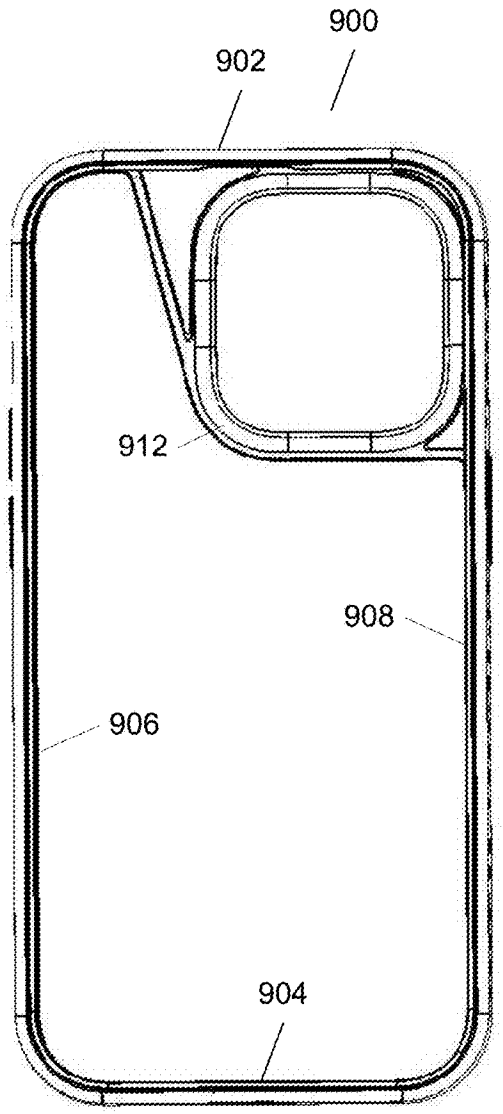
FIG. 9B is a plan view of the frame from the side to which the auxiliary component would be attached.
Figure 9A:
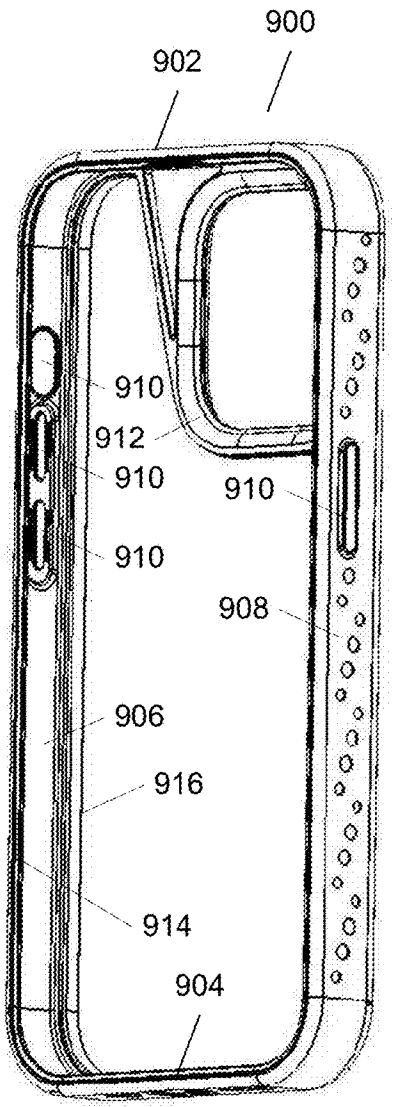
FIG. 9A is a perspective view of an example frame that can be used with, for example, the components of FIGS. 1A, 2-3.

FIGS. 9A-9C illustrate, in simplified form, a frame 900 that can be coupled with an auxiliary storage component as described herein to form a cell phone case incorporating the auxiliary storage component.

More particularly, FIG. 9A is a perspective view of an example frame 900 that can be used with, for example, the components of FIGS. 1A, 2-3. As shown, the frame 900 includes borders on the top 902, bottom 904, and sides 906, 908 that are designed to conform to, and encompass the periphery of a particular cell phone for which it is designed. In that regard it may include features 910 that correspond to buttons, connectors, switches, speakers, microphones, etc. of the cell phone for which it is intended.

The frame 900 further includes, in this example, a portion 912 designed to surround, without obstructing, one or more cameras, lights and/or sensors commonly on the back of such cell phones. The front 914 is open to allow insertion of the intended cell phone and the back 916 is also open to allow for insertion and accommodation of the base plate of an auxiliary storage component constructed according to the teachings herein.

FIG. 9B is a plan view of the frame 900 from the side to which the auxiliary component would be attached.

FIG. 9C is a plan view of the frame 900 from the side into which the intended cell phone would be inserted.

Figure 10:
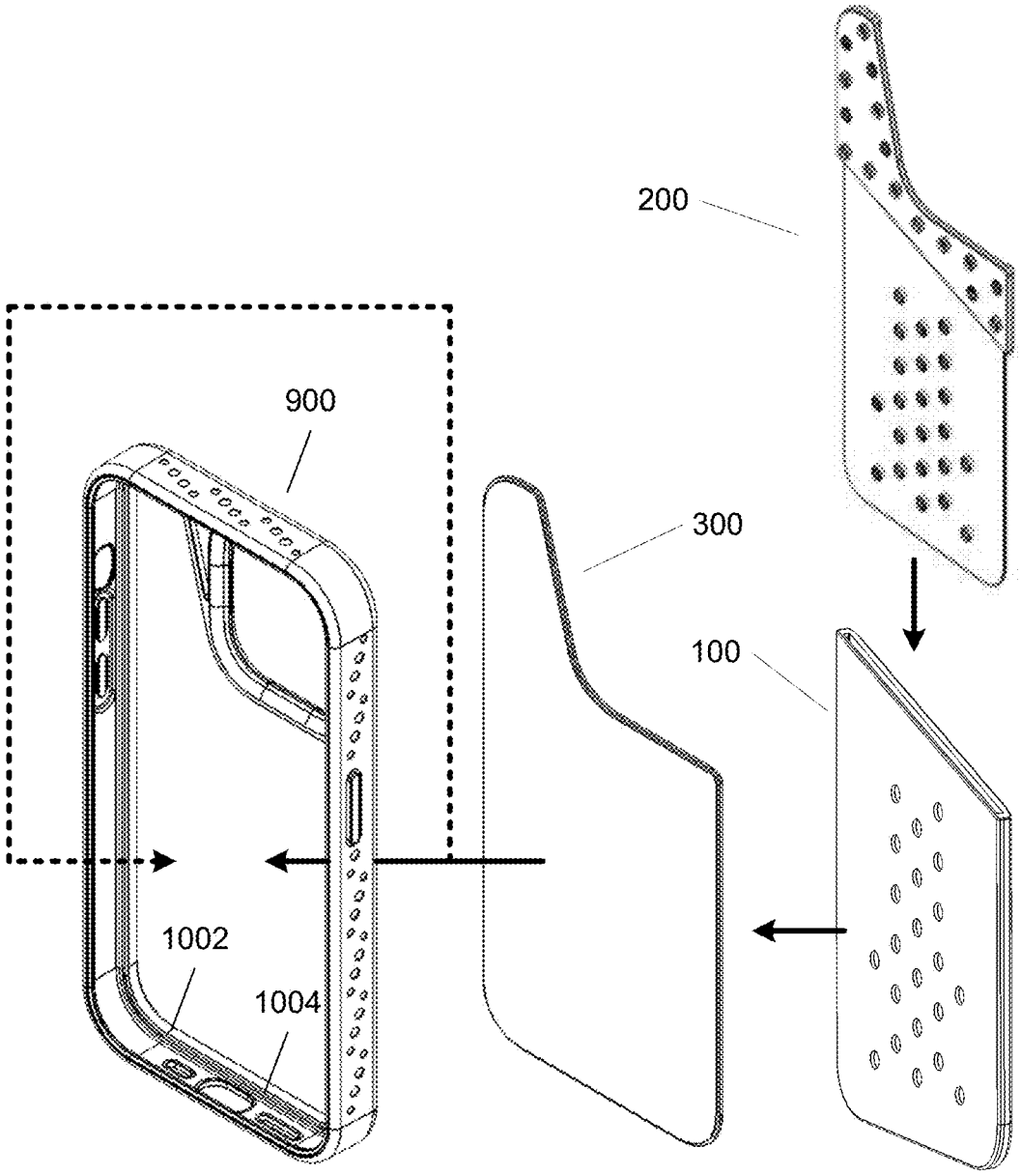
FIG. 10 illustrates, in simplified form, the approach to construction of a cell phone case using the components of FIGS. 1A, 2, 3 and 9A.

FIG. 10 illustrates, in simplified form, the approach to construction of a cell phone case using the components of FIGS. 1A, 2, 3 and 9A.

The components 100, 200, 300 are assembled as described above. Then, depending upon the particular implementation, the completed auxiliary storage component is brought into contact with the back 916 of the frame, for example against a lip 1002 or some/all of its periphery are inserted into a channel at or near the edge 1004 of the frame 900. The auxiliary storage component can then be retained in place, for example, by ultrasonic welding or an adhesive as described herein with respect to joining a support plate and base plate together.

Alternatively, for some implementations, the completed auxiliary storage component can be inserted from the phone side and retained within the frame 900 by a combination of the lip 1002 or channel and an inserted cell phone (not shown), or, as noted above, by ultrasonic welding or an adhesive as described herein with respect to joining a support plate and base plate together.

Figure 11:
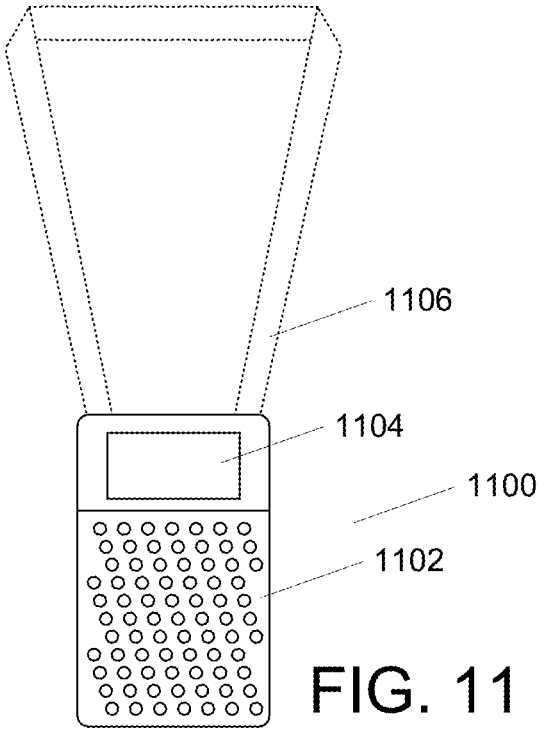
FIG. 11 illustrates, in simplified form, an example variant auxiliary storage component constructed in accordance with the description herein.
Figure 12:
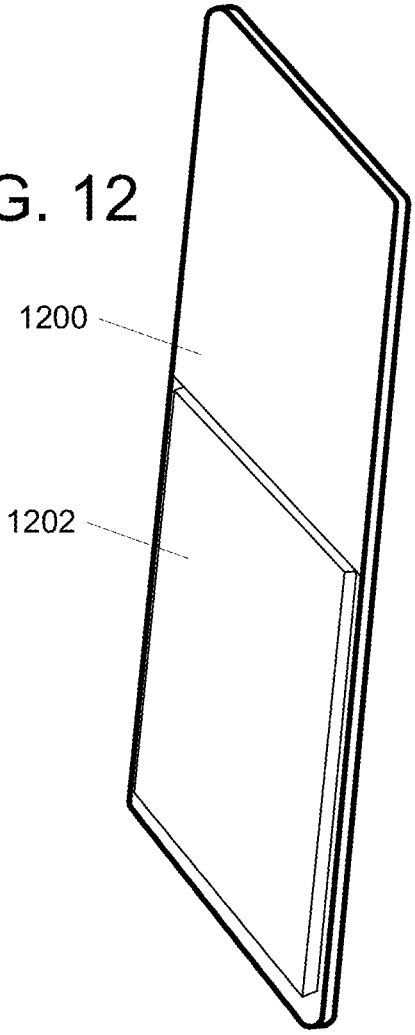
FIG. 12 illustrates, in simplified form, the back of an example tablet computer case that includes an integrated large auxiliary storage component.
Figure 13:
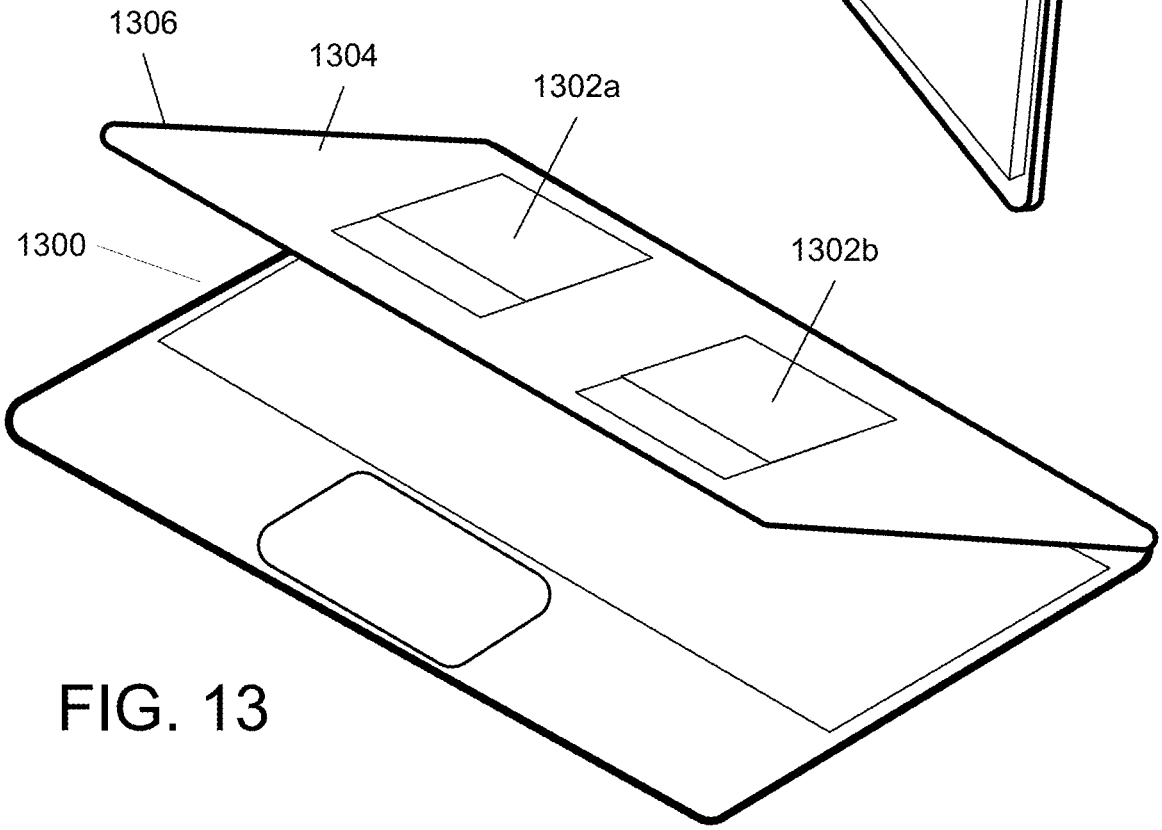
FIG. 13 illustrates, in simplified form, a laptop computer with a pair of auxiliary storage components attached to the back of the lid.

In view of the foregoing, the versatility of auxiliary storage components constructed in accordance with the teachings herein should now be apparent. FIGS. 11-13 illustrate, in simplified form, some examples illustrating the versatility.

FIG. 11 illustrates, in simplified form, an example variant auxiliary storage component 1100 constructed in accordance with the description herein, that has a partially perforated pocket front 1102, a sleeve 1104 that can accept, for example, an ID card or badge, a business card, or can be used as an area where a slogan, company logo or other text/graphics can be printed. Optionally, the auxiliary storage component 1100 can include an integrated lanyard 1106 or one or more places to which a lanyard or other retaining device like a belt clip can be attached.

FIG. 12 illustrates, in simplified form, the back of an example tablet computer 1200 case that includes an integrated large auxiliary storage component 1202.

FIG. 13 illustrates, in simplified form, a laptop computer 1300 with a pair of auxiliary storage components 1302*a*, 1302*b* attached to the back 1304 of the lid 1306 where the screen is located.

The foregoing outlines, generally, the features and technical advantages of one or more implementations that can be constructed based upon the teachings in this disclosure in order that the following detailed description may be better understood. However, the advantages and features described herein are only a few of the many advantages and features available from representative examples of possible variant implementations and are presented only to assist in understanding. It should be understood that they are not to be considered limitations on the invention as defined by the appended claims, or limitations on equivalents to the claims. For instance, some of the advantages or aspects of different variants are mutually contradictory, in that they cannot be simultaneously present in a single embodiment. Similarly, some features or advantages may be applicable to one aspect and inapplicable to others. Thus, the foregoing features and advantages should not be considered dispositive in determining equivalence. Additional features and advantages, although not detailed herein, will be apparent from the teachings of the description, drawings, and claims.

What is claimed is:

1. An apparatus comprising:

an elastic silicone pocket having a base surface including one or more holes therein;

a first plate positioned within the elastic silicone pocket having a side abutting a first side of the base surface;

a second plate having a first side abutting a second side of the base surface opposite the first side; and at least one post coupling the first plate to the second plate via the one or more holes such that the base surface is sandwiched between the first and second plates.

2. The apparatus of claim 1, wherein the elastic silicone pocket has a face surface including multiple through holes therein.

3. The apparatus of claim 1, wherein one of the one or more holes of the base surface is an elongated slot.

4. The apparatus of claim 3, wherein one post of the at least one post is elongated and of a shape corresponding to the elongated slot.

5. The apparatus of claim 1, further comprising:

a frame surrounding the first and second plates.

6. The apparatus of claim 5, wherein the first plate has a first peripheral edge and the second plate has a second peripheral edge, and wherein the first and second peripheral edges are shaped so as to not block a camera of an electronic device inserted into the frame.

7. The apparatus of claim 1, wherein the at least one post couples the first plate to the second plate through ultrasonic welding.

8. The apparatus of claim 1, wherein the at least one post couples the first plate to the second plate using an adhesive.

9. The apparatus of claim 1, wherein the first plate has a first portion within the elastic silicone pocket of a first peripheral shape and extent and the second plate has a second portion corresponding to but larger than the first peripheral shape and extent of the first portion.

10. An apparatus comprising:

an elastic pocket having a portion sandwiched between two plates;

wherein the two plates are coupled to each other via at least one post which passes through the portion;

wherein the portion sandwiched between the two plates and surrounding the at least one post is configured such that stretching a front of the elastic pocket will cause some of the elastic pocket to deform and extend from between the two plates to outside the two plates.

11. An apparatus for use with an electronic device comprising:

a frame having a periphery dimensioned for coupling about a peripheral edge of an electronic device;

an elastic silicone pocket having a base surface with multiple holes therein, a first plate positioned within the pocket abutting a first side of the base surface such that part of the elastic silicone pocket wraps around the first plate;

a second plate abutting a second side of the base surface opposite the first side;

multiple posts within the holes coupling the first plate to the second plate such that the base surface is sandwiched between the first and second plates;

wherein part of a peripheral edge of at least the second plate is coupled to part of the periphery of the frame such that a back of an electronic device inserted into the frame will abut the second plate on a side of the second plate opposite the elastic silicone pocket.

12. The apparatus of claim 11, wherein the first plate has a first upper peripheral edge and the second plate has a second upper peripheral edge, and wherein the first and second upper peripheral edges are shaped so as to not block a camera of an electronic device inserted into the frame.

13. The apparatus of claim 11, wherein the multiple posts couple the first plate to the second plate through ultrasonic welding.

14. The apparatus of claim 11, wherein the multiple posts couple the first plate to the second plate using an adhesive.

15. The apparatus of claim 11, wherein the first plate has a first portion within the elastic silicone pocket of a first peripheral shape and extent and the second plate has a second portion corresponding to but larger than the first peripheral shape and extent of the first portion.

* * * * *